175-48 SR
12/8/87 XR 4,711,123

United States Patent [19]

Christensen

[11] Patent Number: 4,711,123

[45] Date of Patent: Dec. 8, 1987

[54] BUNDLE TYPE DOWNHOLE GAUGE CARRIER

[75] Inventor: Jon B. Christensen, Duncan, Okla.

[73] Assignee: Halliburton Company, Duncan, Okla.

[21] Appl. No.: 801,656

[22] Filed: Nov. 25, 1985

[51] Int. Cl.[4] ..... E21B 47/06

[52] U.S. Cl. ..... 73/151; 166/113; 166/242; 175/48

[58] Field of Search ..... 73/151, 152, 431; 166/64, 65.1, 66, 113, 242, 254, 255; 175/48, 40

[56] References Cited

U.S. PATENT DOCUMENTS

| | | | |
|---|---|---|---|
| 3,109,693 | 11/1963 | Clements et al. | 73/151 |
| 3,149,490 | 9/1964 | Clements et al. | 73/151 |
| 3,225,830 | 12/1965 | Livingston | 166/117.5 |
| 3,939,705 | 2/1976 | Glotin et al. | 73/151 |
| 4,316,386 | 2/1982 | Kerekas | 73/151 |
| 4,570,481 | 2/1986 | McLaurin | 73/152 |
| 4,593,771 | 6/1986 | Comeau | 166/242 X |
| 4,628,995 | 12/1986 | Young et al. | 166/113 |

OTHER PUBLICATIONS

Type "AP" recorder or gauge running case, and anchor shoe blanked-off running case from Halliburton Services Sales & Service Catalog, p. 118.

*Primary Examiner*—Stewart J. Levy
*Assistant Examiner*—Scott M. Oldham
*Attorney, Agent, or Firm*—James R. Duzan; Joseph A. Walkowski

[57] ABSTRACT

A bundle type gauge carrier including a support assembly which may be loaded with a plurality of downhole gauges, the support assembly being quickly insertable in a case assembly incorporated in the pipe string used for a formation test. The gauges are grouped in the support assembly about an unobstructed central flow path, whereby each gauge is exposed to the pressure and temperature of the flowing oil and gas during a drill stem test.

11 Claims, 4 Drawing Figures

BUNDLE TYPE DOWNHOLE GAUGE CARRIER

BACKGROUND OF THE INVENTION

The present invention relates generally to a bundle type carrier for placing gauges used to measure well bore parameters, such as fluid temperature and pressure, in a pipe string, such as is employed in formation or "drill stem" testing.

Gauge carriers are known in the prior art. However, such prior art gauge carriers possess a number of disadvantages. For example, prior art gauge carriers are normally designed to only hold one downhole gauge. Additionally, even prior art carriers designed to hold several gauges must be loaded with gauges while the carrier is held in the slips on the rig floor, a time consuming procedure. Furthermore, prior art gauge carriers do not hold gauges in the flow stream of oil and/or gas from the formation being tested, thereby lessening the accuracy of the measurements made by the gauges held in the carrier. Finally, prior art gauge carriers do not offer a "full bore," or unobstructed axial flow path, a disadvantage in high flow rate wells, since the carrier then acts as a choke to the flow, as well as preventing the running of tools, such as perforating guns, therethrough.

SUMMARY OF THE INVENTION

In contrast to the prior art, the bundle type gauge carrier of the present invention includes a support assembly which may be loaded with a plurality of downhole gauges, the support assembly being quickly insertable in a case assembly incorporated in the pipe string used for a formation test. The gauges are grouped in the support assembly about an unobstructed central flow path, whereby each gauge is exposed to the pressure and temperature of the flowing oil and gas during a drill stem test. cl BRIEF DESCRIPTION OF THE DRAWINGS The present invention will be more fully understood by one of ordinary skill in the art through a review of the following detailed description of the preferred embodiment, taken in conjunction with the accompanying drawings, wherein:

FIG. 1 is a schematic elevation view of a representative offshore installation which may be employed for formation testing purposes, illustrating a formation testing string or tool assembly in position in a submerged well bore, extending upwardly to the floating operating and testing station.

FIGS. 2A and 2B comprise a full section vertical elevation of the bundle type gauge carrier of the present invention.

FIG. 3 comprises a section taken across lines 3—3 of FIG. 2A.

DESCRIPTION OF A FORMATION TESTING STRING

During the course of drilling an oil or gas well, the borehole of the well is filled with a fluid known as drilling fluid or drilling mud. One of the purposes of this drilling fluid is to contain in the formations intersected by the borehole any fluid under pressure which may be found there. To contain the formation fluids, the drilling fluid is weighted with various additives so that the hydrostatic pressure of the drilling fluid at the formation depth is sufficient to maintain the formation fluid within the formation.

When it is desired to test the production capabilities of a formation, a testing string is lowered into the borehole to the formation depth and the formation fluid is allowed to flow into the string in a controlled testing program. Lower pressure is maintained in the interior of the testing string than in the well, as the string is lowered into the borehole. This is usually accomplished by keeping a valve near the lower end of the testing string in a closed position. When the testing depth is reached, a packer is set to seal the borehole thus closing in the formation from the hydrostatic pressure of the drilling fluid in the well annulus between the testing string and the wall of the borehole. Alternatively, the testing string may be stabbed into a production packer which has already been set in the borehole.

To conduct the test, the previously referenced valve at the lower end of the testing string is opened and the formation fluid, free from the restraining pressure of the drilling fluid, can flow into the interior of the testing string.

A typical arrangement for conducting a drill stem or formation test offshore is shown in FIG. 1 of the drawings. Such an arrangement would include a floating work station 10 stationed over a submerged well site 12. The well comprises a well bore 14 typically lined with a casing string 16 extending from the well site 12 to a submerged formation 18. The casing string 16 includes a plurality of perforations 20 at its lower end, which perforations provide communication between the formation 18 and the interior of the well bore 14.

A well head installation 22 is located at the submerged well site, well head installation 22 including a blowout preventer mechanism. A marine conductor 24 extends from the well head installation to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering a formation testing string 34 into the marine conductor and into the well bore 14 by the hoisting means 30.

An hydraulic supply conduit 36 is provided between hydraulic pump 38 on the work deck 26 of the floating station 10 and the well head installation 22 at a point below the blowout preventers. This arrangement allows the pressurizing of a well annulus 40 surrounding the testing string 34.

Testing string 34 includes an upper conduit string portion 42 extending from the work deck 26 to the well head installation 22. An hydraulically operated test tree 44 is located at the lower end of the upper conduit string 42 and is landed in the well head installation 22 to thus support the lower portion of the formation testing string 34.

The lower portion of the formation testing string 34 extends from the test tree 44 to the formation 18. A packer mechanism 46 such as is well known in the art isolates the formation 18 from fluids in the well annulus 40. A perforated tail piece 48 is provided at the lower end of the formation testing string 34 to allow fluid communication between the formation 18 and the interior of the tubular formation testing string 34. The lower portion of the formation testing string 34 includes an intermediate conduit portion 50 and torque transmitting pressure and volume balanced slip joint means 52, lower conduit portion 54 being provided therebelow for imparting packer setting weight to the packer mechanism 46 at the lower end of the formation testing string 34, if the packer mechanism 46 is carried into the well bore on the formation testing string 34.

A circulation valve 56 is located near the lower end of the formation testing string 34. Also near the lower end of the formation testing string 34 below the circulation valve 56 is located a tester valve 58, tester valve 58 preferably being of the well known type which is opened and closed through changes effected in the pressure of well annulus 40 by hydraulic pump 38 through hydraulic supply conduit 36.

During the conduct of the formation test, tester valve 58 is opened and closed a plurality of times to provide for flow of formation fluids under formation pressure through testing string 34 to floating work station 10. As the test is conducted, pressure and temperature of the formation fluid during both the closed and open positions of the tester valve 58 are recorded by pressure and temperature recording devices or gauges placed in one or more gauge carriers. These gauge carriers may be located above the packer at reference numeral 60 or below the packer at reference numeral 62. The bundle type gauge carrier of the present invention is particularly advantageous if employed above packer 46 as indicated by reference numeral 60, since the bundle type gauge carrier of the present invention possesses an unobstructed axial bore of the same diameter as that of tester valve 58, thus permitting the running of a perforating gun therethrough on a wireline, if it is desired to set the formation testing string 34 in place prior to perforating the formation. In addition, the unobstructed bore of the bundle type gauge carrier of the present invention provides a much better flow path than the carriers of the prior art, an advantage which is particularly important when testing high pressure gas wells having large volumetric flows at extremely high pressures.

DETAILED DESCRIPTION OF THE PREFERRED EMBODIMENT

Figure 1:
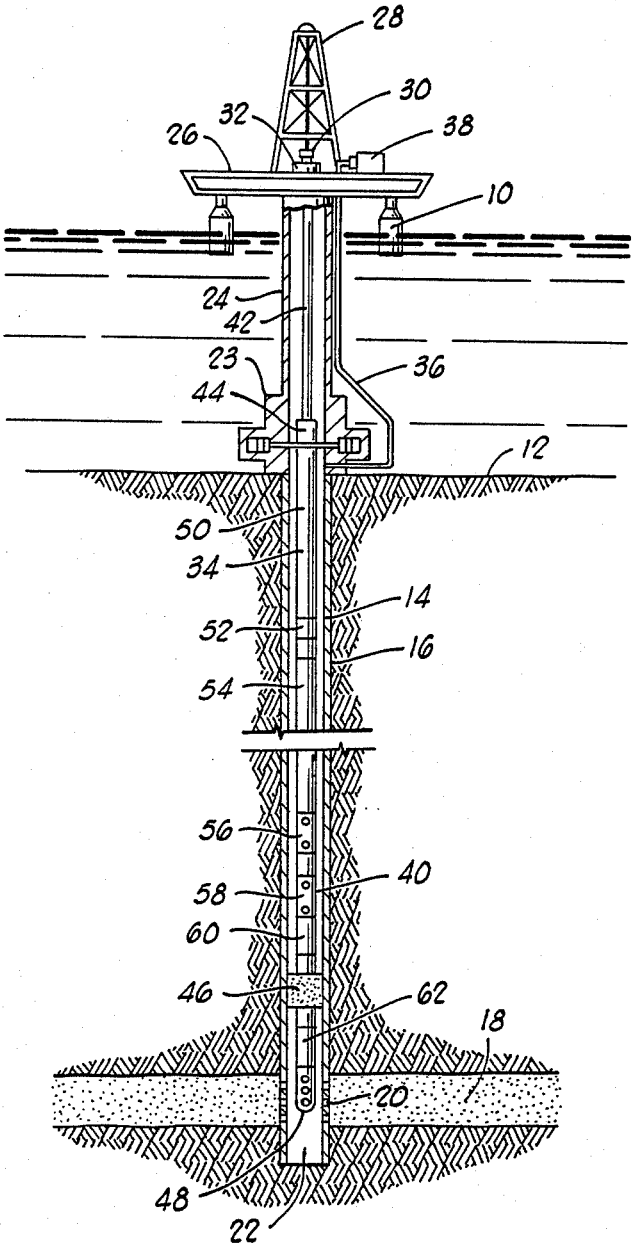

Bundle type gauge carrier 100 of the present invention includes two major assemblies, case assembly 102 and support assembly 104.

Case assembly 102 includes cylindrical top adapter 106, having upper cylindrical exterior surface 108 with flats 110 thereon. Below surface 108, top adapter 106 necks down to exterior threads 112 above seal surface 114, carrying O-ring 116 in seal recess 118. On the interior of top adapter 106, entry bore 120 having tool joint threads in the wall thereof extends downwardly to smaller smooth-walled intermediate bore 122, below which lower top adapter bore 124 of still smaller diameter leads to the bottom of top adapter 106. Top adapter 106 is secured to tubular case 130 therebelow via exterior threads 112, which engage interior threads 132 at the top of case 130. The exterior of case 130 comprises cylindrical surface 134, while the interior bore 136 is also cylindrical. A fluid and pressure tight seal is effected between O-ring 116 carried on top adapter 106 and the interior bore 136 of case 130. At the lower end of case assembly 102, case 130 is secured to lower adapter 140 therebelow by interior threads 138 which engage exterior threads 142 on lower adapter 140. A fluid and pressure tight seal is effected between interior bore 136 of case 130 and lower adapter 140 through the action of O-ring 146 thereagainst, O-ring 146 being held in annular groove 148 opening on seal surface 144. Below exterior threads 142, lower adapter 140 comprises cylindrical exterior surface 150 having flats 152 thereon. At the lower end of lower adapter 140, below surface 152, radially flat annular shoulder 154 leads to exterior tool joint thread 156, by which carrier 100 may be made up to the portion of the formation testing string therebelow. O-ring 158 is carried on annular undercut 160 immediately adjacent shoulder 154, O-ring 158 being for the purpose of effecting a seal between carrier 100 and portions of the formation testing string extending therebelow. The interior of lower adapter 140 comprises smooth-walled upper bore 162, larger intermediate bore 164, also possessing a smooth wall, and lower or exit bore 166, of the same diameter as upper bore 162.

Support assembly 104 includes four longitudinally spaced support rods 180 extending between upper hanger assembly 182 and lower plate 184. In the preferred embodiment, support rods 180 are disposed at 90° intervals (see FIG. 3) about the circumference of support assembly 104. However, the present invention is not so limited to such an arrangement. Upper hanger assembly 182 includes ring-shaped top hanger 190, lower hanger 192, and elastomeric hanger module 194 sandwiched therebetween. Top hanger 182 includes a first set of uniform bores 196 extending longitudinally therethrough, and a second set of stepped bores 198, the latter having a larger upper portion 200 extending via annular shoulder 202 to smaller lower portion 204. Bores 196 are disposed at 90° intervals (see FIG. 3), as are bores 198, the two sets of bores 196 and 198 being, however, rotationally offset 45° . Lower hanger 192 possesses a first set of apertures 206 aligned with first bores 196 of top hanger 182 and a second set of smaller apertures 208 aligned with second bores 198 of top hanger 182. Elastomeric hanger module 194 likewise has a first set of apertures 210 aligned with bores 196 and apertures 206, and a second set of apertures 212 aligned with bores 198 and apertures 208. Support rods 180 extend through apertures 208 in lower hanger 192, apertures 212 in elastomeric hanger module 194, and through lower portions 204 of bores 198 in top hanger 190 into upper portions 200. Support rods 180 are secured to upper hanger assembly 182 by upper hex nuts 214, threaded to the tops of support rods 180 and acting against shoulders 202 through lock washers 216 and by lower hex nuts 218, acting on lower hanger 192 through flat washers 220. This arrangement also clamps together top hanger 190, lower hanger 192 and hanger module 194.

At the lower end of support assembly 104, support rods 180 are secured to ring-shaped lower plate 184 by upper and lower hex nuts 222 and 224, rods 180 extending through 90° circumferentially spaced apertures 226 in lower plate 184. Lock washers 228 and 230 prevent nuts 222 and 224 from backing off of the lower ends of support rods 180. Lower plate 184 possesses a second set of longitudinal apertures therethrough, apertures 232 being rotationally offset 45° from apertures 226, and apertures 232 comprising an upper portion 234 terminating in annular flats 236, which lead inwardly to a smaller diameter lower portion 238. A plurality of gauges 300 are maintained in support assembly 104 between upper hanger assembly 182 and lower plate 184. Each gauge 300 is secured to an upper gauge adapter 250 at the top thereof, and a lower gauge adapter 260 at the bottom thereof. While gauges 300 are shown to be threaded into upper gauge adapters 250 at threads 252, any means well known in the art may be employed. Similarly, while lower gauge adapters 260 are shown to be threaded at 261 into recesses at the bottom of gauges 300, again the precise means of attachment is not so limited, there being many alternatives well known in the art. In the preferred embodiment each upper gauge adapter 250 includes cylindrical body portion 254 having wrench flats 256 on the exterior thereof. Above body portion 254, lower neck 258 extends into an aperture 206 in lower hanger 192. Upper neck 262 extends upward from lower neck 258 through an aperture 206 in elastomeric hanger module 194 into bores 196 in top hanger 190, the top 264 of lower neck 258 abutting the lower surface of hanger module 194. Hex nuts 266 are made up to threads 268 on upper neck 262, against lock washer 270 and flat washer 272, the latter of which is maintained in the top surface of hanger module 194. This arrangement provides for a certain degree of resiliency and shock isolation for the connection of upper gauge adapter 250 to upper hanger assembly 182.

The bottom of each gauge 300, as previously noted, is secured to a lower gauge adapter 260. Each lower gauge adapter possesses an axially oriented bore 280 from the top to the bottom thereof, the lower portion of bore 280 being countersunk and provided with internal threads 282. Above the countersunk portion of bore 280, two perpendicularly oriented passages 284 and 286 intersect bore 280. Thus, a fluid passage is provided through passages 284 and 286 and axial bore 280 to a pressure or temperature transducer of a gauge 300, whereby the temperature or pressure of the formation fluid passing through carrier 100 can be transmitted to the aforesaid transducers.

Lower annular surface 288 of lower gauge adapter 260 rests on ring-shaped elastomeric cushion 290 disposed in an upper portion 234 of an aperture 232 in lower adapter 184. Lower neck 292 of lower gauge adapter 260 extends through cushion 288 and into lower portion 238 of aperture 232. Hex cap screw 294 is inserted into the lower portion of axial bore 280 of lower adapter 260, and engages threads 282 therein. A flat washer 296 abuts the lower surface of lower plate 184, and has a lock washer 298 disposed between the head of cap screw 294 and flat washer 296. When cap screw 294 is made up completely with threads 282 in bore 280, cushion 290 provides isolation from longitudinal shocks for gauge 300.

Figure 3:
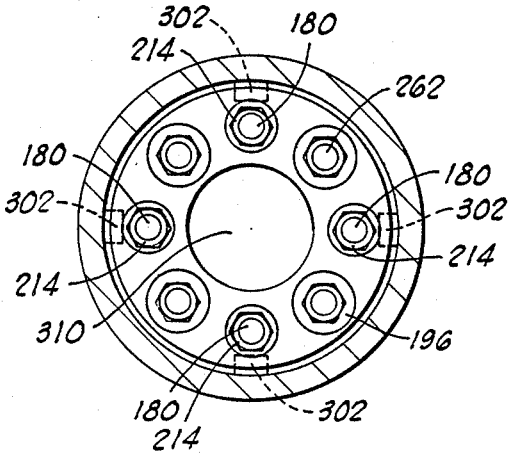

It will be apparent from the foregoing description that support assembly 104 is in fact a rigid support structure for the gauges 300 disposed therein, and defines a longitudinal, axial bore 310 therethrough (see FIG. 3).

Figure 2A:
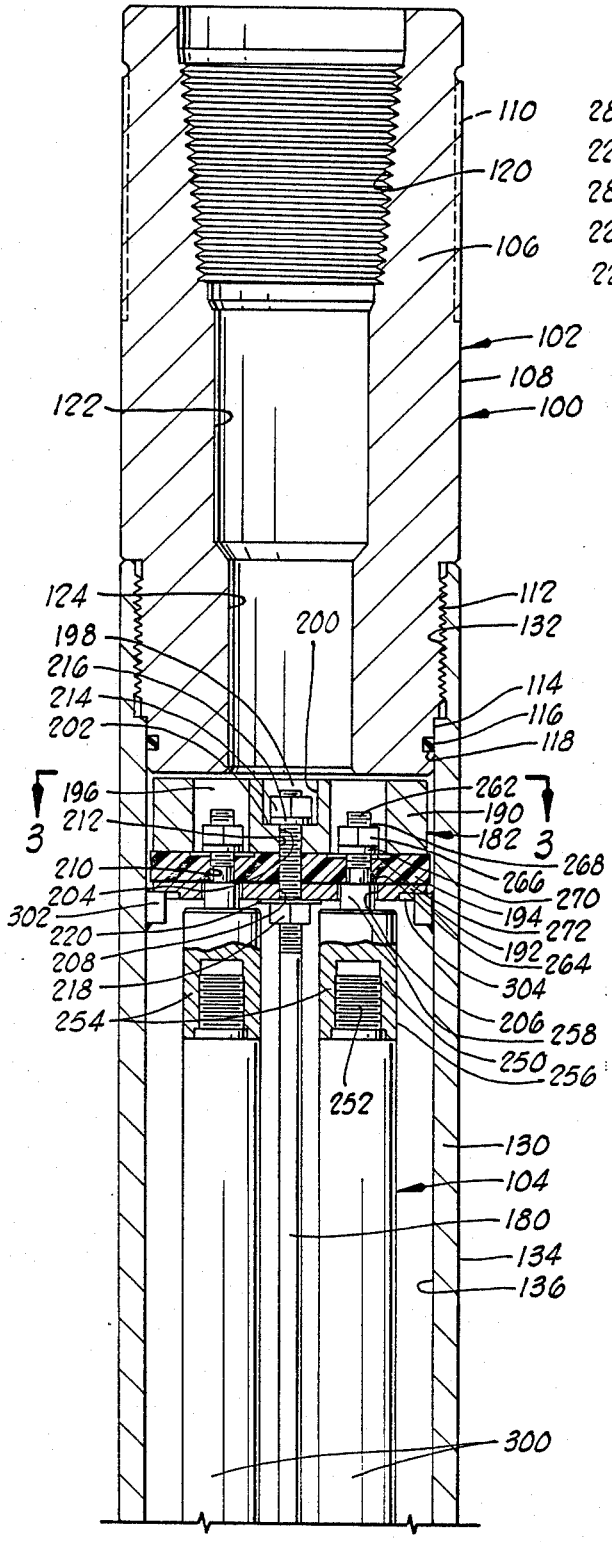
Figure 2B:
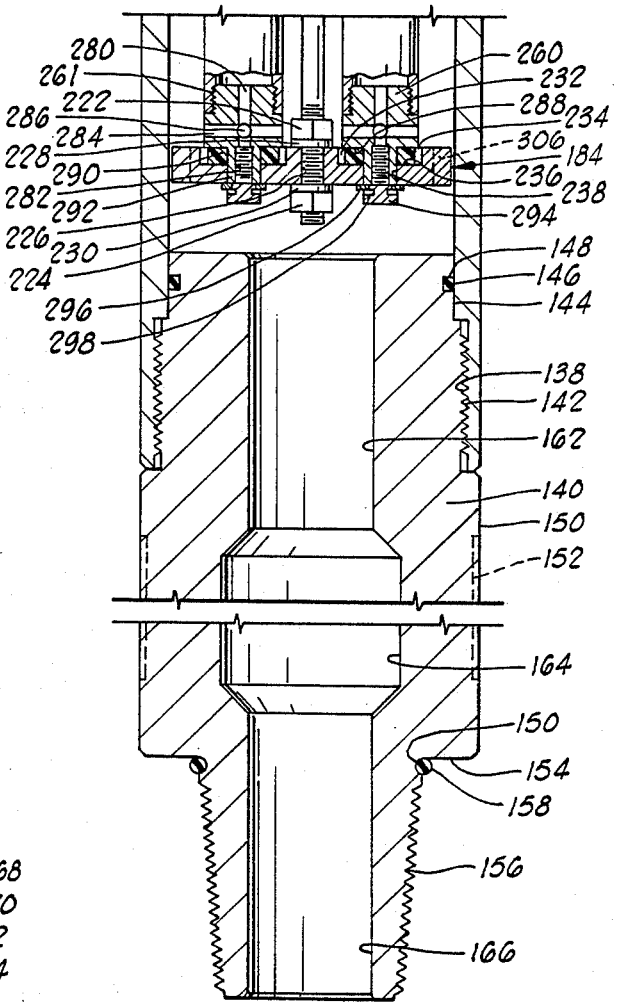

It will be readily appreciated by one of ordinary skill in the art that support assembly 104, with one or more gauges 300 secured thereto, can quickly be placed inside case assembly 102 of carrier 100 by lowering support assembly 104 into case assembly 102 after the latter has top adapter 106 removed. It will be noted that case 130 possesses support pins 302 extending radially inwardly from bore 136. Pins 302 are disposed at 90° intervals about the circumference of bore 136, and are used as supports for upper hanger assembly 182, lower hanger 192 resting thereon. Rotation of support assembly 104 with respect to case assembly 102 is prevented as lower hanger 192 includes a plurality of slots 304 in its lower surface which engage pins 302. Lower plate 184 includes notches 306 in the circumference thereof, notches 306 being disposed at 90° intervals so that lower plate 184 may pass pins 302 as support assembly 104 is lowered into case assembly 102. After support assembly 104 is fully lowered into case assembly 102 and rests on pins 302, top adapter 106 is again made up to case 130 and, as can be seen in FIG. 2A, prevents support assembly 104 from moving upward in case 130 and off of lugs 302.

In practice, the desired number of gauges 300 are secured in support assembly 104 prior to the time carrier 100 is to be incorporated into the formation testing string. This is usually effected by securing upper and lower gauge adapters 250 and 260 to the upper and lower ends of each gauge 300, and securing each upper gauge adapter 250 to upper hanger assembly 182. Lower plate 184 is then secured to lower gauge adapters 260 and to the lower end of support rods 180, as previously shown and described. At the time carrier 100 is to be made up with the testing string, tool joint threads 156 on lower adapter 140 of case assembly 102 are made up with the conduit portion of the testing string below carrier 100. At that time, while case assembly 102 is held by the slips on the rig floor, support assembly 104 with its preloaded gauges 300 is then lowered into case assembly 102, which has had top adapter 106 removed therefrom. Top adapter 106 is then replaced, and the portion of formation testing string above carrier 100 can then be made up thereto by tool joint threads 120 on the interior of upper adapter 106 of case assembly 102. The remainder of the formation testing string is then made up, the string is run into the well bore, and a formation test is performed as previously described.

It will be apparent to one of ordinary skill in the art that many modifications, deletions and additions to the preferred embodiment of the invention as shown herein may be made without departing from the spirit and scope of the claimed invention. For example, fewer or more than four support rods may be employed; support structures other than rods may be used to extend between the upper hanger assembly and the lower plate; the longitudinal support structure, the upper hanger assembly and the lower plate may be integral, such as by welded construction; individual shock absorbers may be provided for the gauges at the upper hanger assembly, instead of using a single elastomeric element; nonelastomeric shock absorbers may also be employed; as previously noted, the design of the upper and lower adapters may be changed, depending on the type of gauge 300 which is to be maintained within carrier 100; support pins 302 may be constructed so as to extend outwardly from upper hanger assembly into grooves or slots in the wall of case 130; different types and sizes of gauges may be run in the same bundle carrier 100; and so on.

I claim:

1. A downhole gauge carrier, comprising:

a case assembly, including an upper adapter and a lower adapter having substantially coaxial bores therethrough and a tubular case extending therebetween defining an interior cavity in communitcation with said adapter bores for removably receiving a support assembly supporting a plurality of gauges;

a support assembly adapted to support a plurality of gauges, to be removably disposed in said cavity of said case assembly and defining an unobstructed longitudinal path therethrough in substantial coaxial alignment with said adapter bores where so disposed, said support assembly including an upper hanger assembly, a lower plate, and a plurality of support rods extending longitudinally therebetween and forming a rigid framework therewith.

2. The apparatus of claim 1, wherein said case assembly includes support pin means releasably engageable with said upper hanger assembly, whereby said support assembly is suspended in said case.

3. The apparatus of claim 2, wherein said upper hanger assembly and said lower plate are ring-shaped.

4. The apparatus of claim 3, wherein said plurality of support rods are disposed at equal intervals about the circumference of said upper hanger assembly and said lower plate.

5. The apparatus of claim 4, wherein each gauge is longitudinally disposed between said upper hanger assembly and said lower plate and secured to both.

6. The apparatus of claim 5, further including an upper gauge adapter and a lower gauge adapter secured to said support assembly, and to the upper and lower ends, respectively, of each of said gauges.

7. The apparatus of claim 6, wherein one adapter of said upper and lower gauge adapters secured to each gauge includes a fluid flow path therein leading to a transducer means in that gauge.

8. The apparatus of claim 6, wherein said upper and lower gauge adapters are secured to said support assembly with shock absorption means.

9. A method of loading a plurality of gauges in a downhole gauge carrier, comprising:

(a) providing a carrier case assembly having an interior cavity;

(b) providing a support assembly to be removably disposed in said cavity;

(c) securing said plurality of gauges in said support assembly; and (d) disposing said support assembly with said plurality of gauges secured therein in said interior cavity of said case assembly.

10. The method of claim 9, further including the step of securing the bottom of said case assembly to a testing string prior to disposing said support assembly therein.

11. The method of claim 10, further including the step of securing the top of said case assembly to a testing string after said support assembly is disposed therein.

* * * * *